US008532537B2

(12) United States Patent
Sasaki et al.

(10) Patent No.: US 8,532,537 B2
(45) Date of Patent: Sep. 10, 2013

(54) IMAGE FORMING APPARATUS AND IMAGE FORMING METHOD

(75) Inventors: Tsutomu Sasaki, Nagano (JP); Naotaka Higuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 258 days.

(21) Appl. No.: 13/037,822

(22) Filed: Mar. 1, 2011

(65) Prior Publication Data

US 2011/0217083 A1 Sep. 8, 2011

(30) Foreign Application Priority Data

Mar. 5, 2010 (JP) ..... 2010-048607

(51) Int. Cl.
*G03G 15/10* (2006.01)

(52) U.S. Cl.
USPC ..... 399/249; 399/296

(58) Field of Classification Search
USPC ..... 399/249, 296
See application file for complete search history.

(56) References Cited

U.S. PATENT DOCUMENTS

| | | | | |
|---|---|---|---|---|
| 7,039,343 | B2 * | 5/2006 | Sasaki et al. | 399/249 |
| 8,023,847 | B2 * | 9/2011 | Toyama et al. | 399/55 |
| 2002/0159801 | A1 * | 10/2002 | Nakashima et al. | 399/307 |
| 2005/0141924 | A1 * | 6/2005 | Kellie | 399/237 |

FOREIGN PATENT DOCUMENTS

| | | | |
|---|---|---|---|
| JP | 2002-278303 | A | 9/2002 |
| JP | 2002-287516 | A | 10/2002 |
| JP | 2002351222 | A * | 12/2002 |
| JP | 2009-098396 | A | 5/2009 |

* cited by examiner

*Primary Examiner* — David Gray
*Assistant Examiner* — Carla Therrien
(74) *Attorney, Agent, or Firm* — Global IP Counselors, LLP

(57) ABSTRACT

The image forming apparatus includes a latent image carrier that holds a latent image thereon, a developer carrier that develops the latent image on the latent image carrier by using a liquid developer including a toner and a carrier liquid, a squeeze roller being in contact with the latent image carrier, that holds an image developed by the developer carrier, to squeeze the liquid developer on the latent image, and a control unit that applies a first bias to the squeeze roller, when a first position of the latent image carrier that does not hold the latent image is in contact with the squeeze roller, and that applies a second bias being different from the first bias to the squeeze roller, when a second position of the latent image carrier that holds the latent image is in contact with the squeeze roller.

7 Claims, 12 Drawing Sheets

IMAGE FORMING APPARATUS AND IMAGE FORMING METHOD

CROSS-REFERENCE TO RELATED APPLICATIONS

This application claims priority to Japanese Patent Application No. 2010-048607 filed on Mar. 5, 2010. The entire disclosure of Japanese Patent Application No. 2010-048607 is hereby incorporated herein by reference.

BACKGROUND

1. Technical Field

The present invention relates to an electrophotographic image forming apparatus and image forming method for developing an image using a liquid developer containing a toner and a carrier liquid, and squeezing the carrier liquid held by the latent image carrier following the development stage.

2. Background Technology

Various wet image forming apparatus have been proposed in which a latent image is developed using a high-viscosity liquid developer in which a solid toner has been dispersed in a liquid solvent, and the electrostatic latent image is rendered visible. The developer used in a wet image forming apparatus includes a solid component (toner particles) suspended in a high-viscosity organic solvent (carrier liquid) with electrical insulating properties, such as silicone oil, mineral oil, or cooking oil. The toner particles are very fine particles having a particle size of about 1 μm. The use of fine toner particles enables the wet image forming apparatus to produce higher quality images than a dry image forming apparatus that uses powdery toner particles having a particle size of about 7 μm.

In the image forming apparatus using a liquid developer containing a toner and a carrier liquid, the excess carrier liquid from the liquid developer developed on the latent image carrier must be removed. The excess toner (fogging toner) adhering to the non-image portions of the latent image carrier also must be removed. It has thus been proposed that the surplus developer such as excess carrier liquid and excess fogging toner be removed using a squeeze roller rotatably making contact with the latent image carrier in the direction opposite that of the rotational direction of the latent image carrier (the direction of both circumferential velocities being the same).

A removing member for removing the surplus carrier from the latent image carrier has been disclosed in Patent Citation 1 as such a squeeze roller. As disclosed in Patent Citation 2, wasteful consumption of the toner and the carrier is reduced and abnormal electrical discharges with the latent image carrier are avoided by controlling the engagement/disengagement operation of the sweep roller, the timing of the disengagement operation, and the bias voltage application operation. A two-stage surplus carrier removing means is disclosed in Patent Citation 3 that prevents disturbance of the toner particles in the image portion by using different revolution speeds, roller diameters and roller hardnesses in the relation between the first stage and the second stage.

Japanese Patent Application Publication No. 2002-278303 (Patent Citation 1) is an example of the related art.

Japanese Patent Application Publication No. 2002-287516 (Patent Citation 2) is an example of the related art.

Japanese Patent Application Publication No. 2009-98396 (Patent Citation 3) is an example of the related art.

SUMMARY

Problems to be Solved by the Invention

However, when the removing member (hereinafter referred to as the "squeeze roller") is rotatably pressed against the latent image carrier, as described in Patent Citations 1 through 3, a liquid remnant (ink meniscus) occurs at the nip entrance between the squeeze roller and the latent image carrier. A meniscus is even more likely to occur when the circumferential velocity of the latent image carrier and the circumferential velocity of the removing member are substantially equal to each other. Toner particles from the fogging toner that has moved from the non-image portion of the latent image carrier are sometimes retained by this meniscus. When the image portion of the latent image carrier reaches the nip entrance, these toner particles move toward the latent image carrier, adhere to the image portion, and are redeveloped. When redevelopment occurs, density abnormalities occur in which the density is increased at the front end of the image portion, and the uniformity of the image quality deteriorates.

The following is an explanation of the density abnormalities caused by the meniscus at the front end of the image with reference to FIGS. 3 through 7. FIG. 3 is a view showing the formation (FIG. 3*a*) and discharge (FIG. 3*b*) of a meniscus between the squeeze roller and a photoreceptor, FIG. 4 is a view showing the change in the size of the meniscus relative to the amount of movement by the photoreceptor surface, FIG. 5 is a view showing the optical density relative to the position from the leading edge of the image, and FIG. 6 is a view showing the image density distribution on printing paper during solid image formation.

As shown in FIG. 3*a*, the meniscus is formed at the nip entrance between the squeeze roller and the photoreceptor. A meniscus is caused by such factors as the surface tension of the liquid developer relative to the squeeze roller, and the electric field formed between the photoreceptor and the squeeze roller. Usually, a bias value (e.g., 400 V) is applied to the squeeze roller, the bias value being between the surface potentials of the image portion and the non-image portion of the photoreceptor (e.g., 600 V in the non-image portion and 50 V in the image portion). Because of the difference in potential between the photoreceptor and the squeeze roller, an electric field acts when the non-image portion of the photoreceptor opposes the squeeze roller so that the field pushes the toner particles in the liquid developer towards the squeeze roller, and moves the excess toner particles (fogging toner) adhering to the non-image portion towards the squeeze roller. The movement of the toner particles drags the carrier liquid along as well, and a meniscus is formed containing toner particles and carrier liquid.

When the supply of liquid developer has begun between the photoreceptor and the squeeze roller, the meniscus, as shown in FIG. 4, continues to increase in size over time, i.e., as the amount of movement by the surface of the photoreceptor increases, until a fixed value has been reached. Note that the size of the meniscus can be defined by measuring the length of the meniscus on the peripheral surface of the squeeze roller shown in FIG. 3*a*.

The meniscus grows as the photoreceptor rotates and is discharged when the photoreceptor transitions from the non-image portion to the image portion, as shown in FIG. 3*b*. In other words, because the surface potential of the photoreceptor is higher than the surface potential of the squeeze roller in the non-image portion but this relationship is reversed in the image portion, the electric field acting between the squeeze roller and the photoreceptor is also reversed, and the toner particles retained by the meniscus move to the image portion of the photoreceptor where they re-adhere to (and are redeveloped on) the photoreceptor.

FIG. 5 is a view showing the image density relative to the position from the leading edge of the image when a solid image is printed. Essentially, when a solid image is printed, the image density should be constant regardless of the position of the image. However, the meniscus described above causes density abnormalities in which the density is higher at the front end of the image. FIG. 6 is a view showing the image density distribution during the printing of a solid image on printing paper. As shown in the drawing, the density abnormalities occur at the front end of the image when solid image printing is started on printing paper.

FIG. 7 shows the timing chart when solid images are continuously printed at a predetermined time interval. In the chart, a solid image is printed in the printing ranges. The drawing shows the change over time in both the size of the meniscus (measured as the length of the meniscus) and image density when the voltage (bias) Vsq applied to the squeeze roller is constant. As shown in the drawing, the meniscus grows between the printing ranges. Once saturation has been reached (a length of approximately 3 mm), discharge of the toner particles inside the meniscus begins at the start of the printing region, and density abnormalities occur in which the density increases at the front end of each image. In Patent Citation 1 to Patent Citation 3, no measures are taken to address the density abnormalities at the front end of the image.

Means Used to Solve the Above-Mentioned Problems

In order to solve this above mentioned problem, an image forming apparatus is provided. The image forming apparatus includes a latent image carrier that holds a latent image thereon, a developer carrier that develops the latent image on the latent image carrier by using a liquid developer including a toner and a carrier liquid, a squeeze roller being in contact with the latent image carrier, that holds the latent image developed by the developer carrier, to squeeze the liquid developer on the latent image, and a control unit that applies a first bias to the squeeze roller, when a first position of the latent image carrier that does not hold the latent image is in contact with the squeeze roller, and that applies a second bias being different from the first bias to the squeeze roller, when a second position of the latent image carrier that holds the latent image is in contact with the squeeze roller.

DETAILED DESCRIPTION OF EXEMPLARY EMBODIMENTS

Figure 1:
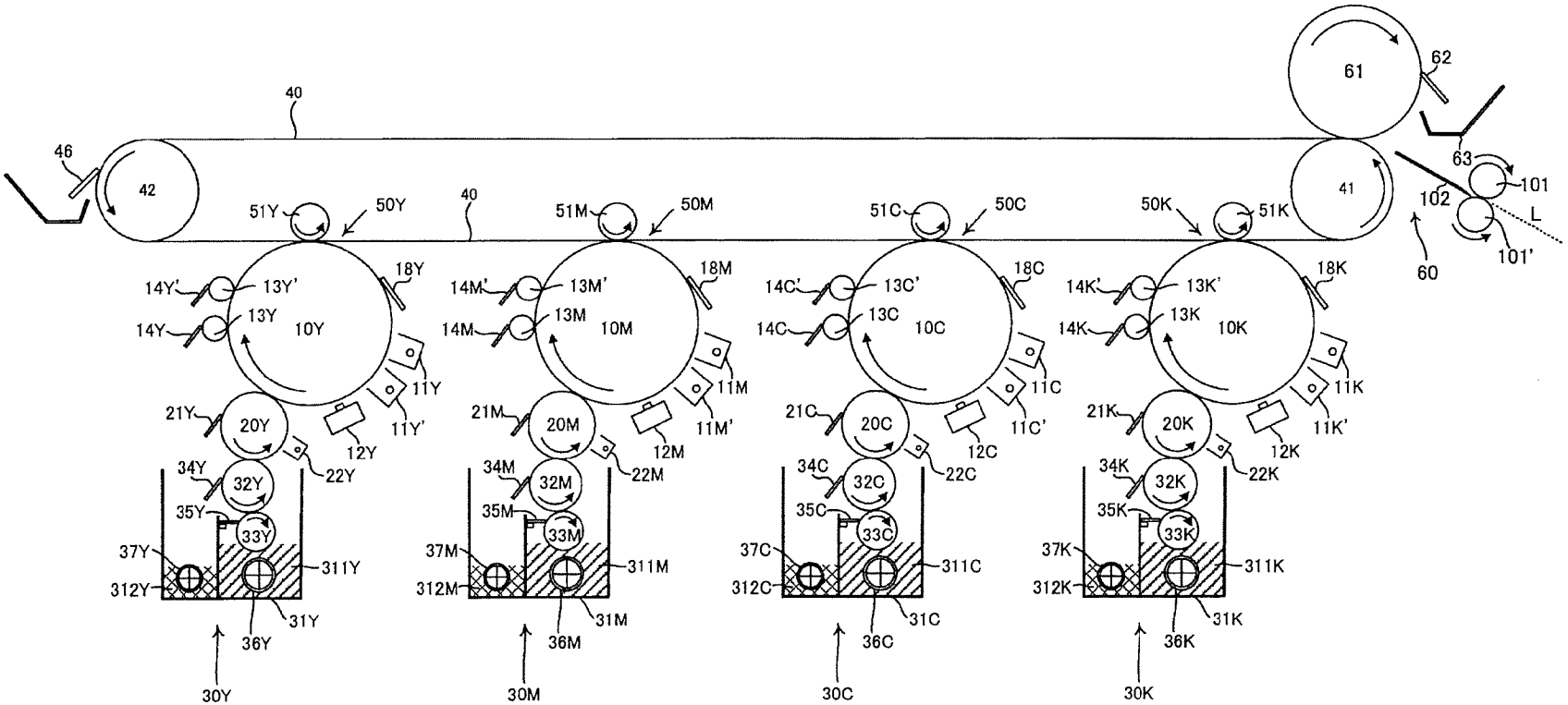
FIG. 1 is a view showing the main components of the image forming apparatus.
Figure 2:
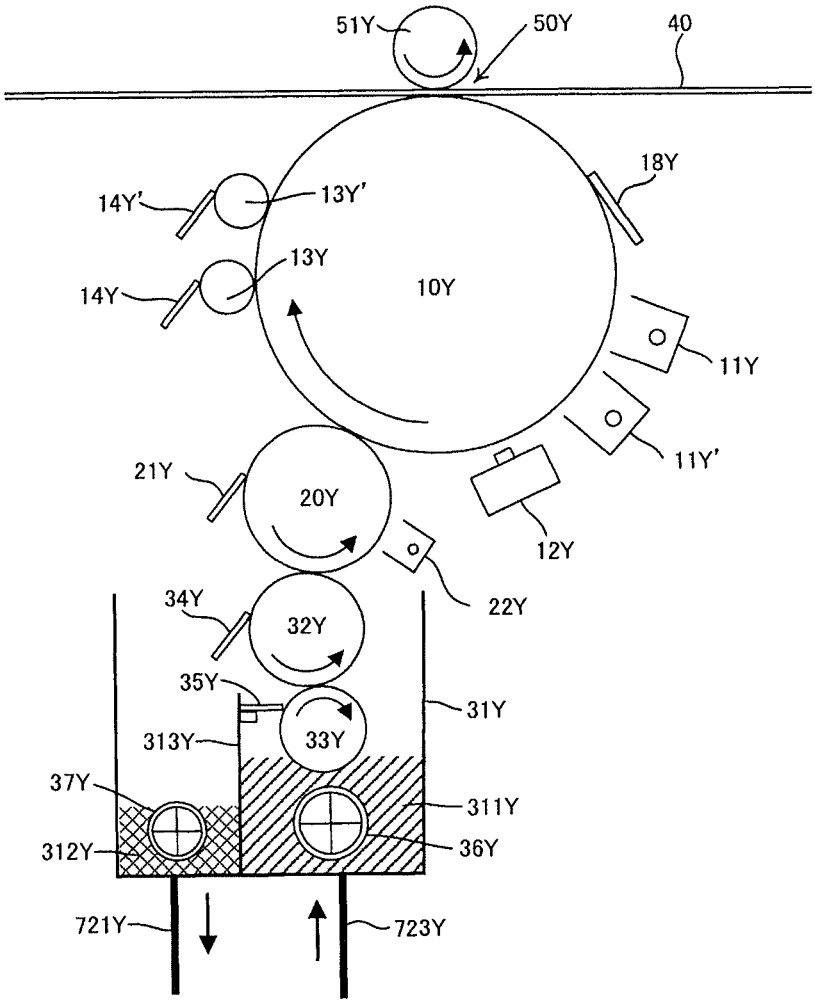
FIG. 2 is a cross-sectional view showing the main components of the image forming unit and the developer carrier.

The following is an explanation of embodiments of the invention with reference to the accompanying drawings. FIG. 1 is a view showing the main components of the image forming apparatus according to an embodiment of the invention, and FIG. 2 is a view showing the main components of the image forming portion and the developing portion (developing unit) for the color yellow (Y) in the image forming apparatus according to the embodiment of the invention.

As shown in FIG. 1, the image forming apparatus in the present embodiment is configured from a transfer belt 40; four image forming units whose main components are photoreceptors 10Y, 10M, 10C, 10K; four developing units 30Y, 30M, 30C, 30K disposed correspondingly in regard to the photoreceptors 10Y, 10M, 10C, 10K ("latent image carriers" in the invention); a secondary transfer unit disposed on the right side of the transfer belt 40 in the drawing; and a cleaning unit disposed on the left side of the transfer belt 40 in the drawing.

Because the configurations of the image forming units and the developing units 30Y, 30M, 30C, 30K are the same for all of the colors, the following is an explanation based on the image forming unit and developing unit for the color yellow (Y).

The developing unit 30Y is a device for developing the latent image formed on the photoreceptor 10Y using a liquid developer, and the main components in the device are a developing roller 20Y, an intermediate roller 32Y, an anilox roller 33Y, a liquid developer container 31Y for storing liquid developer, and a toner charger 22Y for charging the toner on the developing roller 20Y.

On the outer periphery of the developing roller 20Y are disposed a cleaning blade 21Y, the intermediate roller 32Y, and the toner charger 22Y. The surface of the intermediate roller 32Y is caused to make contact with the developing roller 20Y and the anilox roller 33Y, and an intermediate roller cleaning blade 34Y is disposed on the outer periphery of the intermediate roller.

A regulating member 35Y presses against the anilox roller 33Y to adjust the amount of liquid developer pumped from a developer storage unit 311Y. In the three-roller system using the intermediate roller 32Y as with the developing unit of the present embodiment, the amount of liquid developer can be regulated by configuring the intermediate roller 32Y to press against the anilox roller 33Y. Therefore, a configuration is also possible in which the regulating member 35Y is not disposed.

Liquid developer is supplied from the developer supply unit not shown in the drawing to the developer storage unit 311Y via a transport route 723Y. In the present embodiment, a partitioning plate 313Y has a shape in which both ends are a step lower than the center. The liquid developer overflows from the developer storage unit 311Y into a recovered liquid storage unit 312Y via the step lower portions to keep the liquid level of the developer in the developer storage unit 311Y constant.

A recovery auger 37Y is disposed inside the recovered liquid storage unit 312Y. The recovery auger 37Y transports the recovered liquid containing the liquid developer that has overflowed from the developer storage unit 311Y and the liquid developer recovered by the various blades, which is recovered by the developer supply unit via transport route 721Y. After the density has been adjusted by a developer replenishing unit, the recovered liquid can once again be supplied via a transport route 723Y for re-use.

The liquid developer contained by the developer container 31Y is not a volatile liquid developer having a low concentration (approximately 1-2 wt %) of the commonly used Isopar (trademark: Exxon) as the carrier, and a low viscosity, and having volatility at room temperature. The liquid developer is a non-volatile liquid developer having a high concentration and a high viscosity, and having non-volatility at room temperature. In other words, the liquid developer in the invention is a high-viscosity liquid developer (having a viscoelasticity of approximately 30 to 300 mPa·s at 25° C. and a shearing velocity of 1000 (1/s) using a Haake RheoStress RS600), in which solid particles having an average particle size of 1 μm of a pigment or other colorant dispersed in a thermoplastic resin are added along with a dispersant to a liquid solvent such as an organic solvent, silicone oil, mineral oil or cooking oil to obtain a toner solid concentration of approximately 25%.

The anilox roller 33Y functions as a supplying roller to supply and coat the intermediate roller 32Y with liquid developer. The anilox roller 33Y is a cylindrical member, and is a roller having a corrugated surface in which fine, uniform grooves are carved into the surface in a spiral shape to allow the surface to easily carry developer. Liquid developer is supplied by the anilox roller 33Y from the developer container 31Y to the developing roller 20Y. During the operation of this device, as shown in the drawing, the anilox roller 33Y rotates in the clockwise direction, and the intermediate roller 32Y is coated with liquid developer.

The regulating member 35Y is a metal blade having a thickness of approximately 200 μm, which makes contact with the surface of the anilox roller 33Y, regulates the film thickness and amount of liquid developer carried by the anilox roller 33Y, and adjusts the amount of liquid developer supplied to the developing roller 20Y.

The intermediate roller 32Y is a cylindrical member, which is centered on the rotational axis as shown in the drawing, rotates in the counterclockwise direction similar to the developing roller 20Y, and makes counter contact with the developing roller 20Y. The intermediate roller 32Y has a structure similar to the developing roller 20Y in which an elastic layer is provided to the outer periphery of a metal inner core.

An intermediate roller cleaning blade 34Y is disposed downstream from the contact position between the intermediate roller 32Y and the developing roller 20Y, removes the liquid developer not supplied to the developing roller 20Y, and returns the recovered liquid to the recovered liquid storage unit 312Y in the developer container 31Y.

The developing roller 20Y is a cylindrical member, and rotates in the counterclockwise direction around the rotational axis as shown in the drawing. In the developing roller 20Y, an elastic layer composed of a tube made of polyurethane rubber, silicone rubber, NBR, PFA, or the like is provided to the outer peripheral portion of an inner core of metal such as iron.

The developing roller cleaning blade 21Y is configured from rubber or a similar material that makes contact with the surface of the developing roller 20Y, and is disposed downstream in the rotational direction of the developing roller 20Y from the developing nip portion where the developing roller 20Y presses against the photoreceptor 10Y. The blade scrapes off and removes the liquid developer remaining on the developing roller 20Y. The remaining developer scraped off and removed by the developing roller cleaning blade 21Y drops into the recovered liquid storage unit 312Y inside the developer container 31Y, and is re-used.

The toner charger 22Y is electric field applying unit which increases the charging bias of the surface of the developing roller 20Y. An electric field is applied by a corona discharge at a position near the toner charger 22Y to charge the liquid developer transported by the developing roller 20Y.

The image forming unit is configured from two corona chargers 11Y, 11Y', an exposure unit 12Y, a photoreceptor squeezing device, a primary transfer unit 50Y, and a photoreceptor cleaning blade 18Y arranged in sequential order on the outer periphery of the photoreceptor 10Y in the direction of rotation. In this image forming unit, the developing roller 20Y in the developing unit 30Y makes contact with the outer periphery of the photoreceptor 10Y between the exposure unit 12Y and a first squeeze roller 13Y.

The photoreceptor 10Y is a photosensitive drum having a structure in which a photosensitive layer such as an amorphous silicon photoreceptor is formed on the outer peripheral surface of a cylindrical member. The photoreceptor rotates in the clockwise direction.

The two corona chargers 11Y, 11Y' are disposed upstream in the rotational direction of the photoreceptor 10Y from the nip portion between the photoreceptor 10Y and the developing roller 20Y. Voltage is applied from a power source device not shown in the drawing, and the photoreceptor 10Y is corona-charged. The exposure unit 12Y exposes the photoreceptor 10Y charged by corona chargers 11Y, 11Y' to light downstream from the corona charger 11Y in the rotational direction of the photoreceptor 10Y, and a latent image is formed on the photoreceptor 10Y.

The photoreceptor squeezing device disposed upstream from the primary transfer unit 50Y faces the photoreceptor 10Y and is disposed downstream from the developing roller 20Y. The photoreceptor squeezing device is configured from a first squeeze roller 13Y including an elastic roller member making rolling contact with the photoreceptor 10Y, a second squeeze roller 13Y', and photoreceptor squeeze roller cleaning blades 14Y, 14Y'. This device functions to recover (squeeze) the surplus carrier liquid and unwanted fogging toner from the toner image developed on the photoreceptor 10Y, and to increase the toner particle ratio inside the visible image (toner image). A bias (voltage) is applied to the photoreceptor squeeze rollers 13Y, 13Y' in order to attract the fogging toner to the photoreceptor squeeze rollers 13Y, 13Y'.

The photoreceptor squeeze roller cleaning blades 14Y, 14Y' are provided so as to make contact with the photoreceptor squeeze rollers 13Y, 13Y'. The liquid developer containing recovered carrier liquid and fogging toner is scraped off and falls into the recovered liquid storage unit 312Y in the developer container 31Y.

Having passed the squeeze device composed of the first photoreceptor squeeze roller 13Y and the second photoreceptor squeeze roller 13Y', the surface of the photoreceptor 10Y enters the primary transfer unit 50Y. In the primary transfer unit 50Y, the developer image developed on the photoreceptor 10Y is transferred by a primary transfer backup roller 51Y to the transfer belt 40. In the primary transfer unit 50Y, it is the action of the transfer bias applied to the primary transfer backup roller 51Y that transfers the toner image on the photoreceptor 10Y to the transfer belt 40. Here, the photoreceptor 10Y and the transfer belt 40 are configured to move at the same velocity. The drive load used for movement and rotation are reduced, and disturbance of the visible toner image on the photoreceptor 10Y is suppressed.

A photoreceptor cleaning blade 18Y that makes contact with the photoreceptor 10Y downstream from the primary transfer unit 50Y cleans the liquid developer rich with carrier components on the photoreceptor 10Y.

The transfer belt 40 (transfer member) has a three-layer structure in which an elastic polyurethane intermediate layer is provided on top of a polyimide base layer, and a PFA surface layer is provided on top of the intermediate layer. The transfer belt 40 is stretched between a belt drive roller 41 and a tension roller 42, and is used so the toner image is transferred on the PFA surface layer. In the image forming apparatus of the present embodiment, a transfer belt 40 is used as the transfer member. However, this member is not limited to a belt. Various types of transfer members can be used such as rollers and drums.

The primary transfer units 50Y, 50M, 50C, 50K, which are formed by disposing primary transfer backup rollers 51Y, 51M, 51C, 51K opposite the photoreceptors 10Y, 10M, 10C, 10K with the transfer belt 40 interposed therebetween, make contact with the photoreceptors 10Y, 10M, 10C, 10K at the transfer positions, and the toner images of the various colors on the developed photoreceptors 10Y, 10M, 10C, 10K are successively superimposed and transferred onto the transfer belt 40 to form a full color toner image on the transfer belt 40.

In the secondary transfer unit 60, a secondary transfer roller 61 is disposed opposite the belt drive roller 41 with the transfer belt 40 interposed therebetween, and both form the secondary transfer unit (nip portion). In the secondary transfer unit, the monochromatic or full color toner image formed on the transfer belt 40 is transferred to a transfer medium such as paper, film or cloth transported in a transfer medium transport route L. A fixing unit not shown in the drawing is disposed downstream from the sheet material transport route L. Heat and pressure are applied to fix the monochromatic toner image or full color toner image transferred to the transfer medium.

The transfer medium is supplied to the secondary transfer unit by a paper supplying device (not shown in the drawing). The transfer medium set in the paper supplying device is sent one sheet at a time on a predetermined timing to the transfer medium transport route L. In the transfer medium transport route L, the transfer medium is transported to the secondary transfer unit by gate rollers 101, 101', and the monochromatic or full color toner image formed on the transfer belt 40 is transferred to the transfer medium.

The transfer belt 40 is stretched between the tension roller 42 and the drive roller 41, and a cleaning blade 46 is disposed to press against and clean the transfer belt 40 at the point where the transfer belt 40 is stretched by the tension roller 42.

Figure 3A:
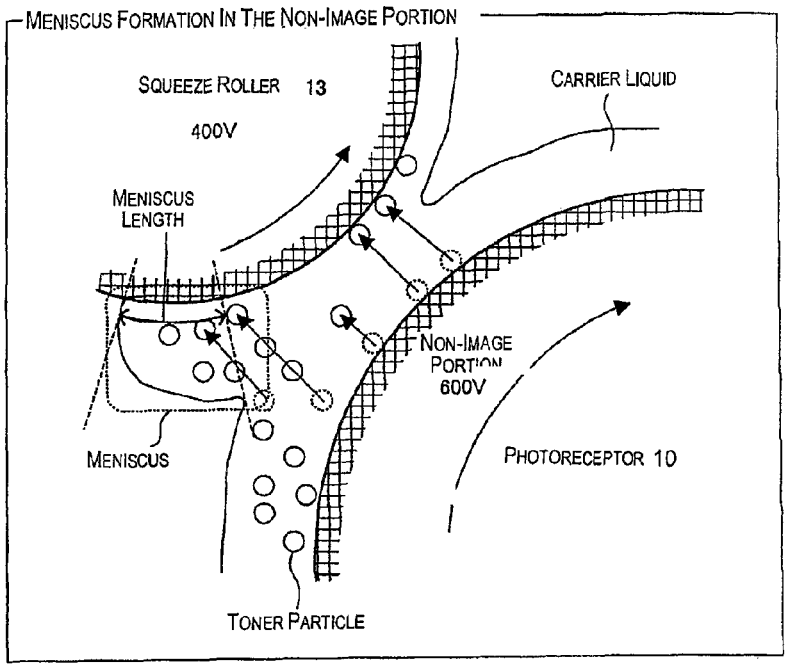
FIG. 3 is a view showing meniscus formation and meniscus discharge.
Figure 3B:
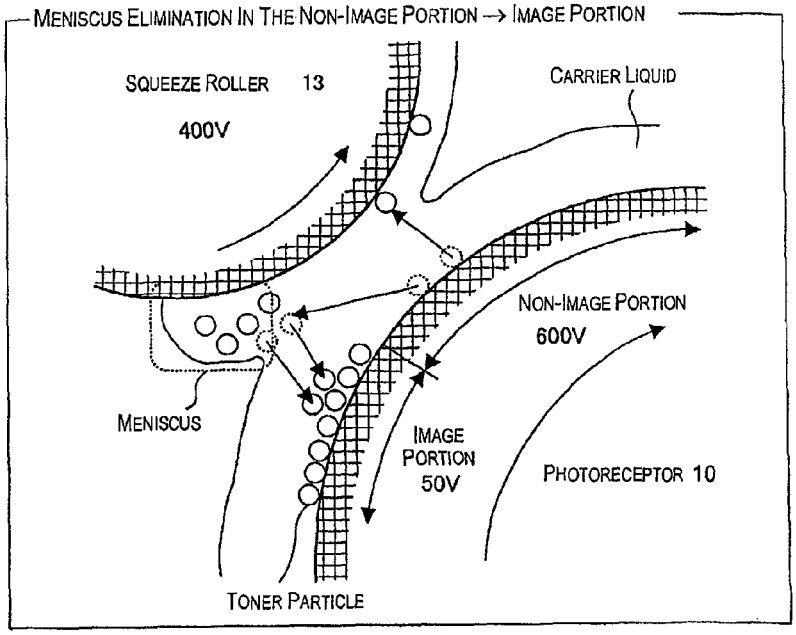
Figure 4:
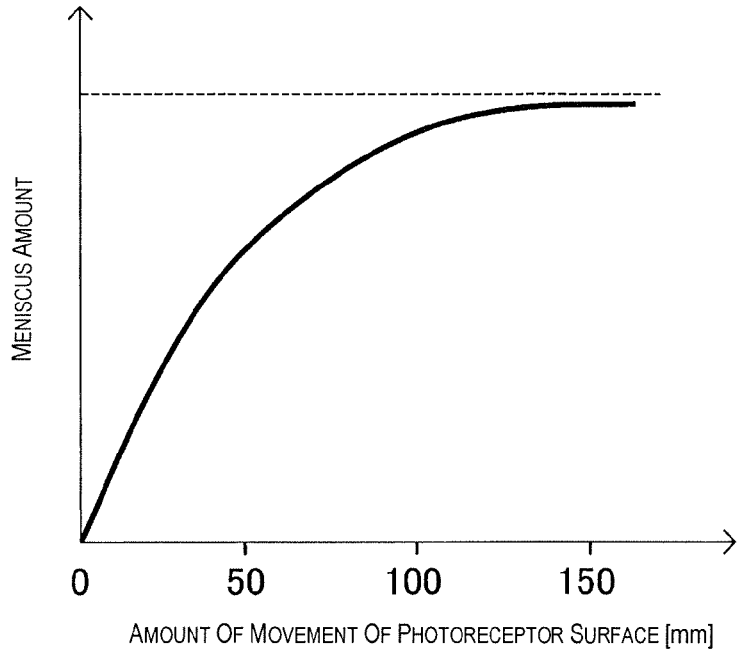
FIG. 4 is a view showing the increase in the size of the meniscus relative to the amount of movement by the photoreceptor surface.
Figure 5:
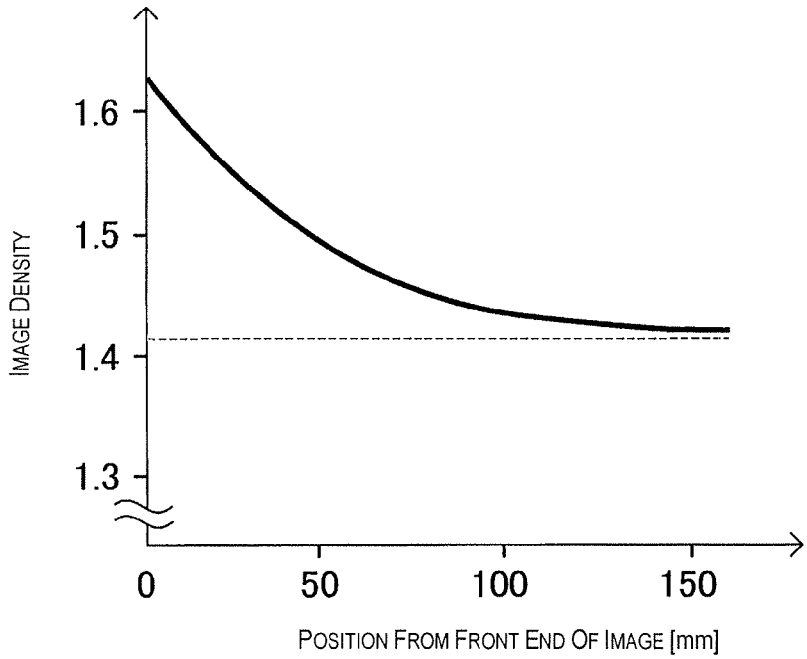
FIG. 5 is a view showing the optical density relative to the position from the leading edge of the image.
Figure 6:
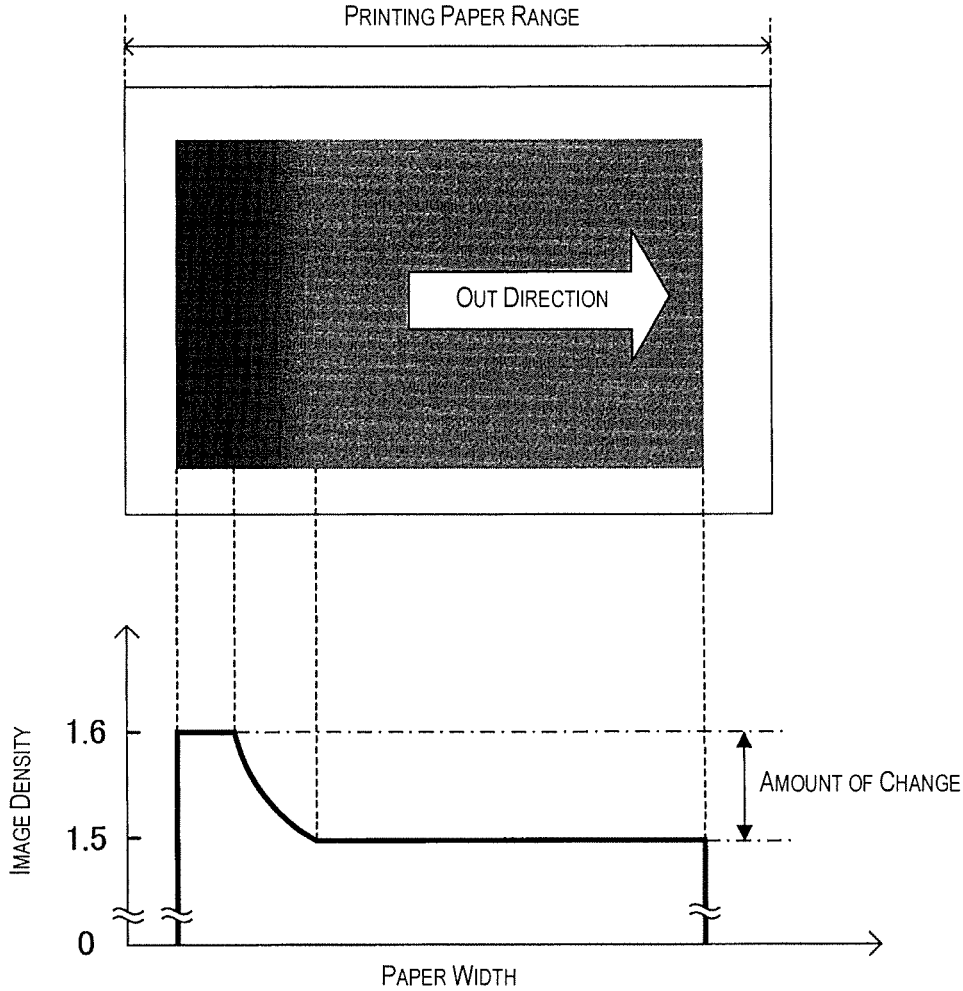
FIG. 6 is a view showing the image density distribution on printing paper during solid image formation.
Figure 8A:
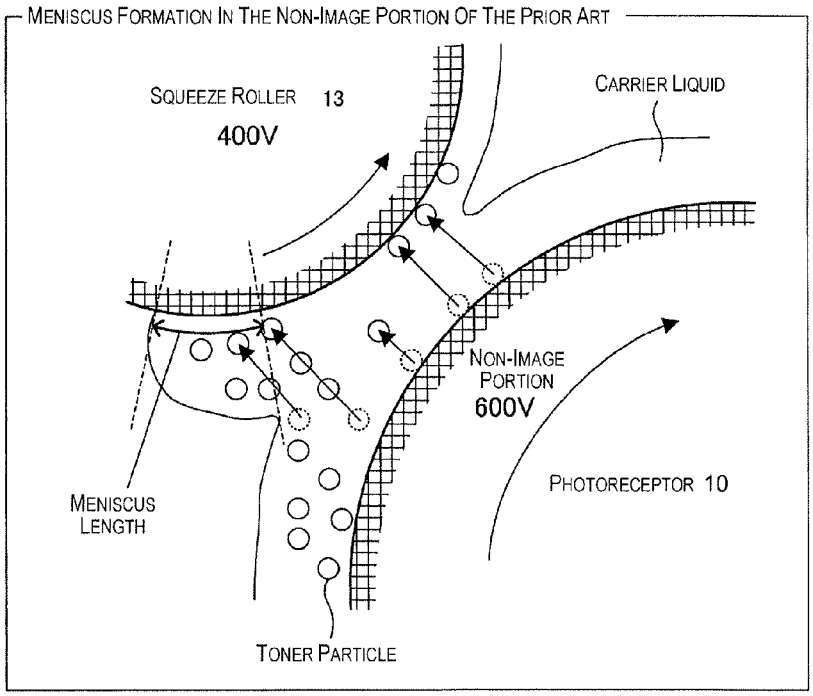
FIG. 8 is a view showing meniscus formation in the non-image portions of the prior art and the invention.
Figure 8B:
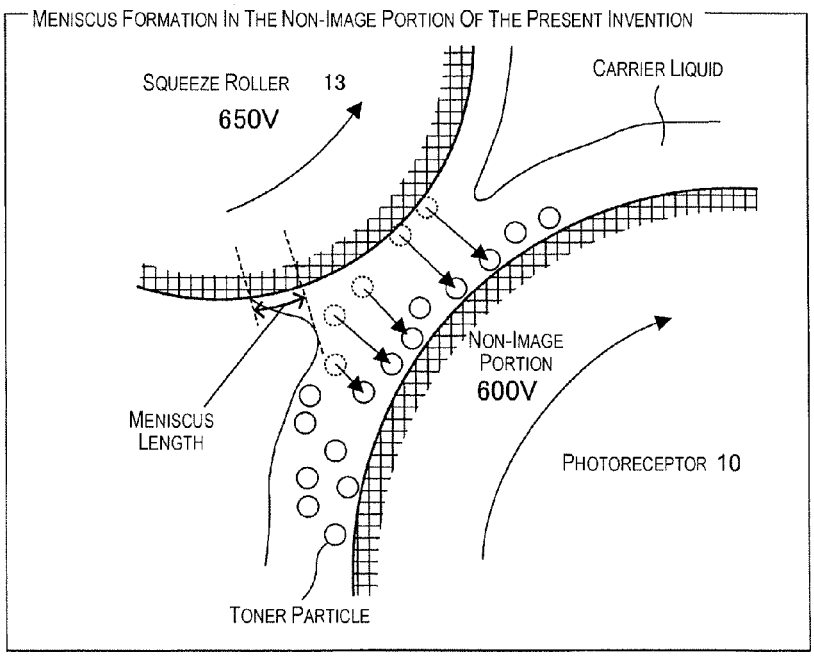

FIG. 8 is a view used to explain the basic principles of the invention. FIG. 8*a* shows meniscus formation in the prior art, and FIG. 8*b* shows meniscus formation in the embodiment of the invention. As explained using FIG. 3*a*, the main reason that a meniscus occurs is because an electric field acts between the photoreceptor 10 and the squeeze roller 13 at the position where the photoreceptor 10 faces the squeeze roller 13. By adjusting the bias applied to the squeeze roller 13, the invention weakens the electric field acting between the photoreceptor 10 and the squeeze roller 13. Because the electric field also acts in the opposite direction, the growth of the meniscus is suppressed, and density abnormalities are prevented.

FIG. 8*b* shows meniscus formation in the embodiment of the invention. In the present embodiment, the surface potential in the non-image portion of the photoreceptor 10 is 600 V, and the surface potential of the squeeze roller 13 is 650 V. When the squeeze roller 13 faces a non-image portion, the surface potential on the squeeze roller 13 side is higher than on the photoreceptor 10 side, and the direction of the electric field is reversed. Reversing the direction of the electric field can push the toner particles against the non-image portion, and suppress the growth of the meniscus. The surface potential of the squeeze roller 13 can also be increased to a level that weakens the electric field acting between both components without having to reverse the direction of the electric field.

Figure 9:
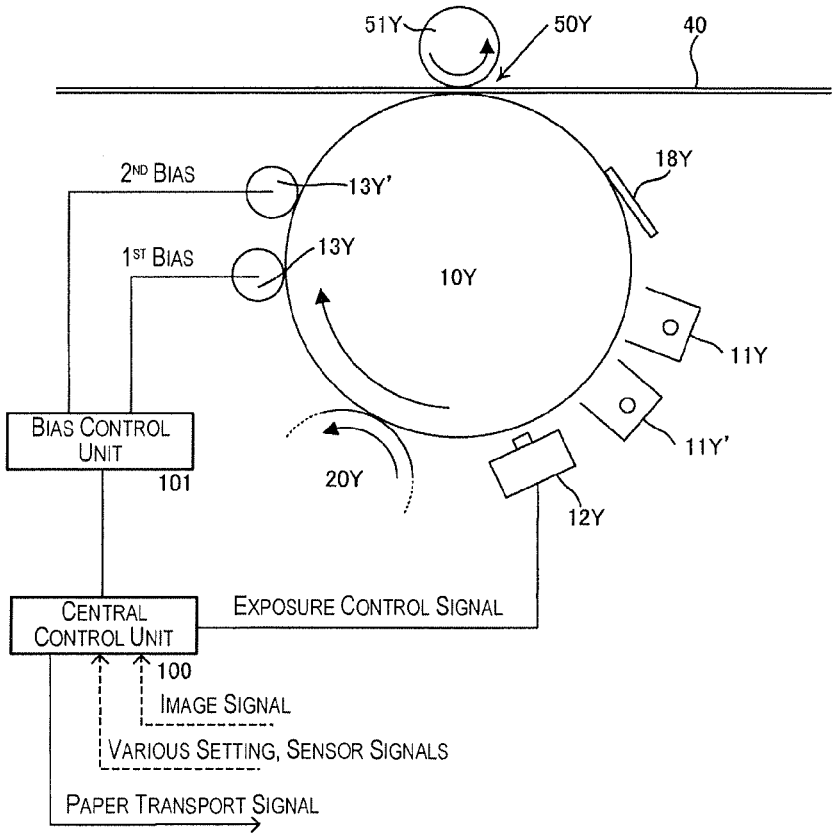
FIG. 9 is a view showing the control configuration for the image forming apparatus in an embodiment of the invention.

FIG. 9 is a view showing the control configuration for the image forming apparatus in an embodiment of the invention. As shown in the drawing, the image forming unit is controlled by a control unit including a central control unit 100 and a bias control unit 101. The bias control unit 101 is able to individually control the first bias applied to the first squeeze roller 13Y and the second bias applied to the second squeeze roller 13Y'.

Abnormal densities caused by meniscus formation occur mainly on the first squeeze roller 13Y side disposed on the upstream side of the photoreceptor 10. Also, the electric field acting on the nip is stronger because there are fewer toner particles adhering to the second squeeze roller 13Y'.

As for the electric field acting between the nip and the second squeeze roller 13Y', the reduction in the second bias downstream can suppress superfluous toner compression on the photoreceptor 10, improve the re-dispersion of toner particles, and ensure good cleaning properties. Even when the second bias is greater than the first bias, surplus liquid developer can be recovered outside of the printing region. In such instances, the toner particles that have not been removed are recovered by the photoreceptor cleaning blade 18Y, the cleaning blade 46 disposed on the transfer belt 40, and other cleaning members disposed downstream.

The central control unit 100 controls the exposure unit 12Y based on the inputted image signals, and controls the formation of the latent image on the photoreceptor 10Y. The central control unit 100 controls the values and the application timing for the first bias and the second bias applied by the bias control unit 101.

When an image is printed, the printable range on the printing paper depends on the configurational constraints on the image forming apparatus, and on the printing range set by the user. An image is formed through toner particles being introduced into this region. It is practically impossible to address density abnormalities at the front end of images in each image portion and non-image portion (i.e., in each portion where toner particles are and are not introduced) inside the printing region. Therefore, in the image forming apparatus in the present embodiment, the first bias (simply called "the bias" below) applied to the first squeeze roller 13Y in the range outside of the printing region is adjusted.

Therefore, the central control unit 100 determines the correspondence between the position in which the first squeeze roller 13Y faces the photoreceptor 10Y and the position of the printing paper in the secondary transfer unit 60 on the basis of the exposure control signals for the exposure unit 12Y to form a latent image, control signals for transporting the printing paper, or the printing paper transport status according to various sensors. On the basis of the results of this determination, the bias applied to the first squeeze roller 13Y can be adjusted at least in the range outside of the printing range.

Figure 10:
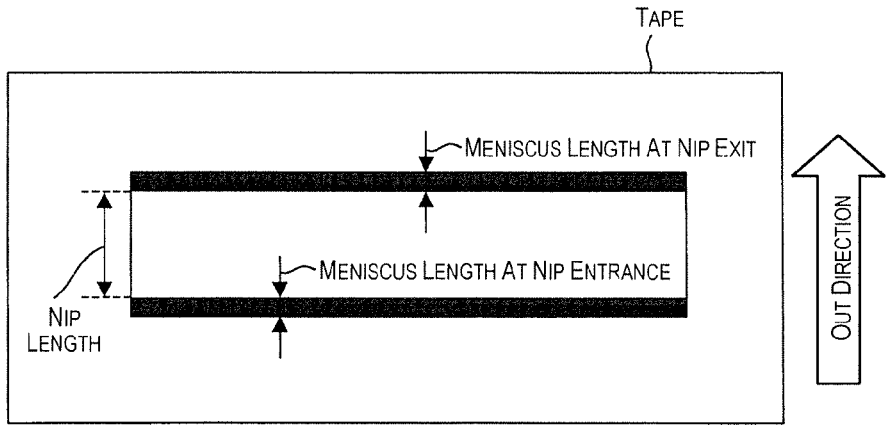
FIG. 10 is a view showing measurement of the meniscus length.
Figure 11:
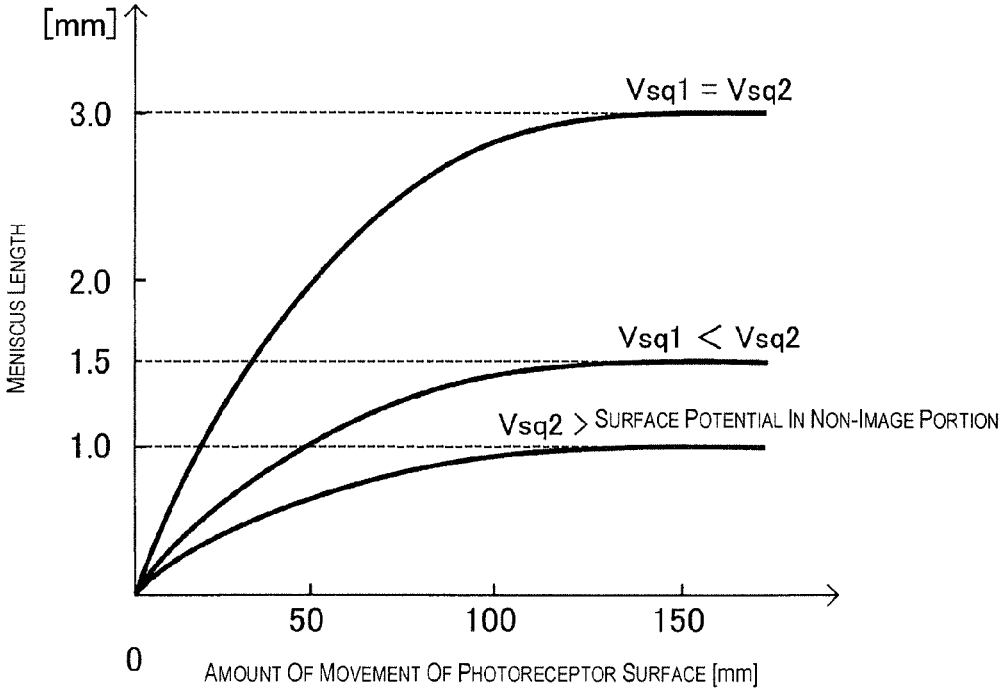
FIG. 11 is a view showing the increase in meniscus length relative to the amount of movement by the photoreceptor surface.

FIGS. 10 and 11 are views used to explain how the measurement is conducted when the bias applied to the first squeeze roller 13Y is changed. In this measurement, the bias is changed and the length of the meniscus on the photoreceptor 10 is measured. When the meniscus length is measured, the first squeeze roller 13Y and the photoreceptor 10 are pulled apart from the contact state, and mending tape (810, manufactured by 3M) is affixed to and then peeled off from the remaining contact portion on the photoreceptor 10Y.

FIG. 10 shows the meniscus length during measurement. The state of the peeled-off tape is shown schematically. In the central portion of the tape, substantially no toner particles remain in the nip portion in which the photoreceptor makes contact with the first squeeze roller 13Y, whereas bands of toner particles formed by the meniscus can be observed at the nip entrance and nip exit near the nip portion. In the present embodiment, the meniscus length is measured by determining the width of the band on the nip entrance side.

FIG. 11 shows the growth of the meniscus between the photoreceptor 10Y and the first squeeze roller 13Y. The bias applied to the first squeeze roller 13Y is changed, and the meniscus is measured. Vsq1 is the prior art bias applied to the first squeeze roller 13Y. In the present embodiment, it is 400 V. By changing Vsq2 relative to Vsq1, three measurement results are obtained.

First, when Vsq2=Vsq1 (400 V in the present embodiment), that is, when the bias is the same as the prior art, the photoreceptor 10Y is rotated, and the meniscus length grows to 3 mm. In contrast, when the bias is set so that Vsq2 is greater than Vsq1 (450V in the present embodiment), the growth of the meniscus is reduced to 1.5 mm. When Vsq2 is increased (650 V in the present embodiment) and is greater than the surface potential of the non-image portion (600 V in the present embodiment), the growth of the meniscus length is reduced to 1.0 mm. By increasing the bias applied to the first squeeze roller 13Y in this way, the size of the meniscus formed in the present embodiment can be reduced, the density abnormalities at the front end of the image caused by the meniscus can be suppressed, and an image with fewer image irregularities can be formed.

Figure 12:
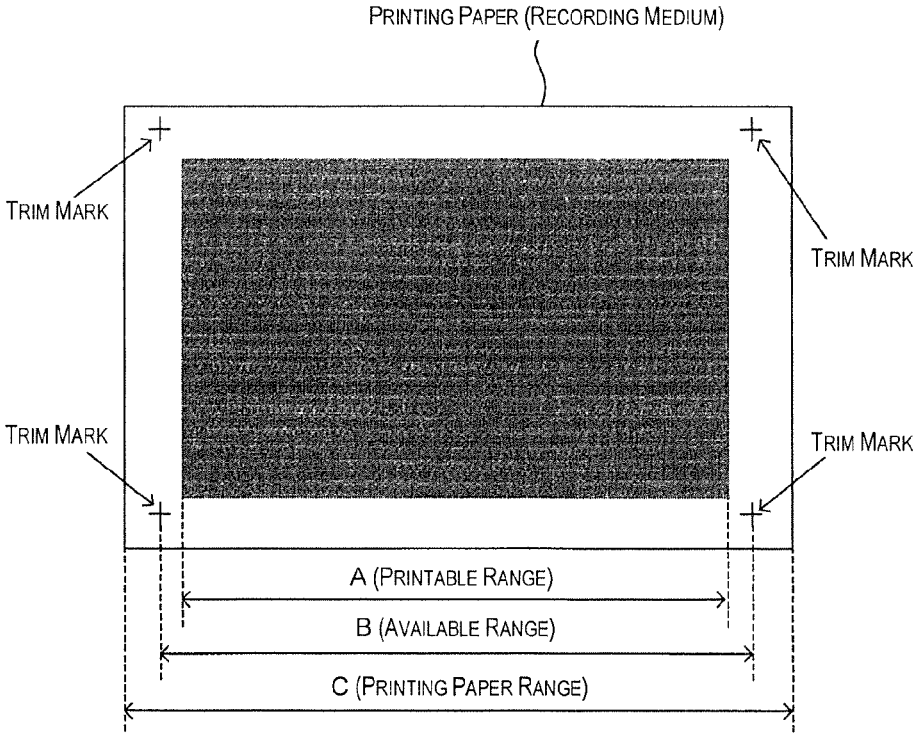
FIG. 12 is a view showing the various ranges for printing paper (recording medium)

The following is an explanation of the printing range on the printing paper (recording medium) using FIG. 12. FIG. 12 shows the various ranges on printing paper. Printing paper has a region in which the image forming apparatus can print (the portion shaded in gray). This region corresponds to the region of the printing paper excluding the top margin B and the bottom margin C. In the present embodiment, the printing range is defined as the range within this region in the out direction, that is, the range indicated by arrow A. In the present embodiment, at least a portion of this range is not in the printing range. As shown in the drawing, trim marks indicating the trimming range for the printer paper can be included in the top margin B and the bottom margin C. In the present embodiment, the image irregularities caused by the meniscus in the non-printing range can be suppressed by changing the bias applied to the first squeeze roller 13Y.

Figure 13:
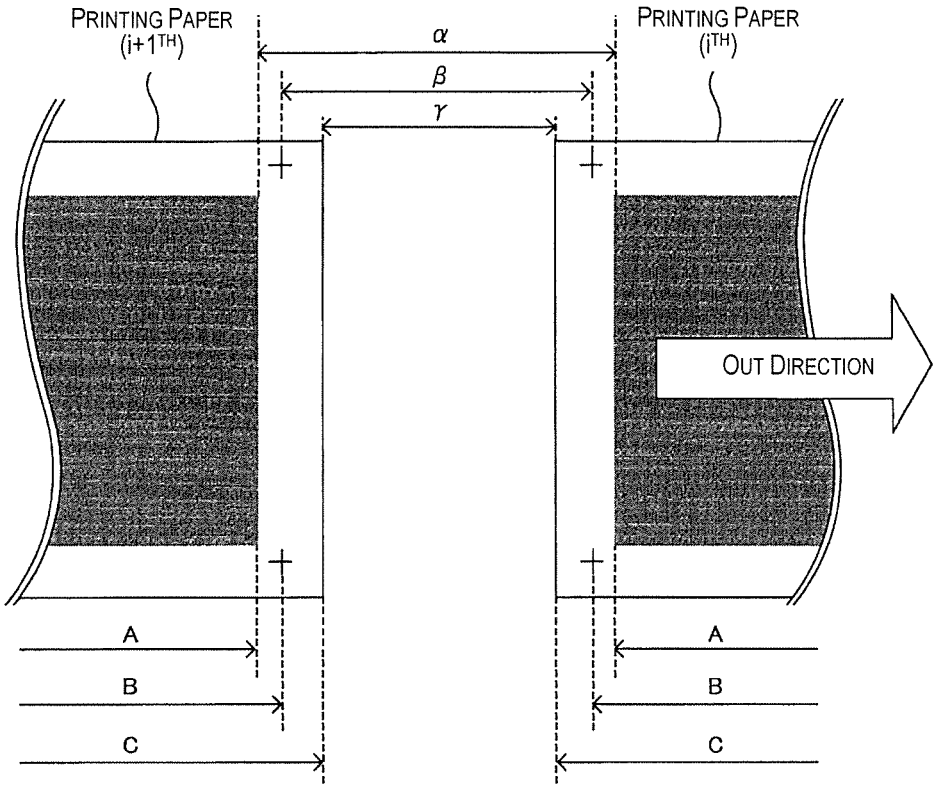
FIG. 13 is a view used to explain the non-printing range in an embodiment of the invention.

FIG. 13 is a view showing continuous printing being performed on a plurality of sheets of the printing paper (recording medium) explained in FIG. 12. As shown in the drawing, the image forming apparatus can print a plurality of sheets of printing paper at predetermined interval β. In this case, at least a portion of a range a between the rear end of the printing range A on the preceding or $i^{th}$ sheet of the printing paper explained in FIG. 12 and the front end of the printing range A on the subsequent or $i+1^{th}$ sheet of printing paper corresponds to the non-printing range in the invention.

Figure 7:
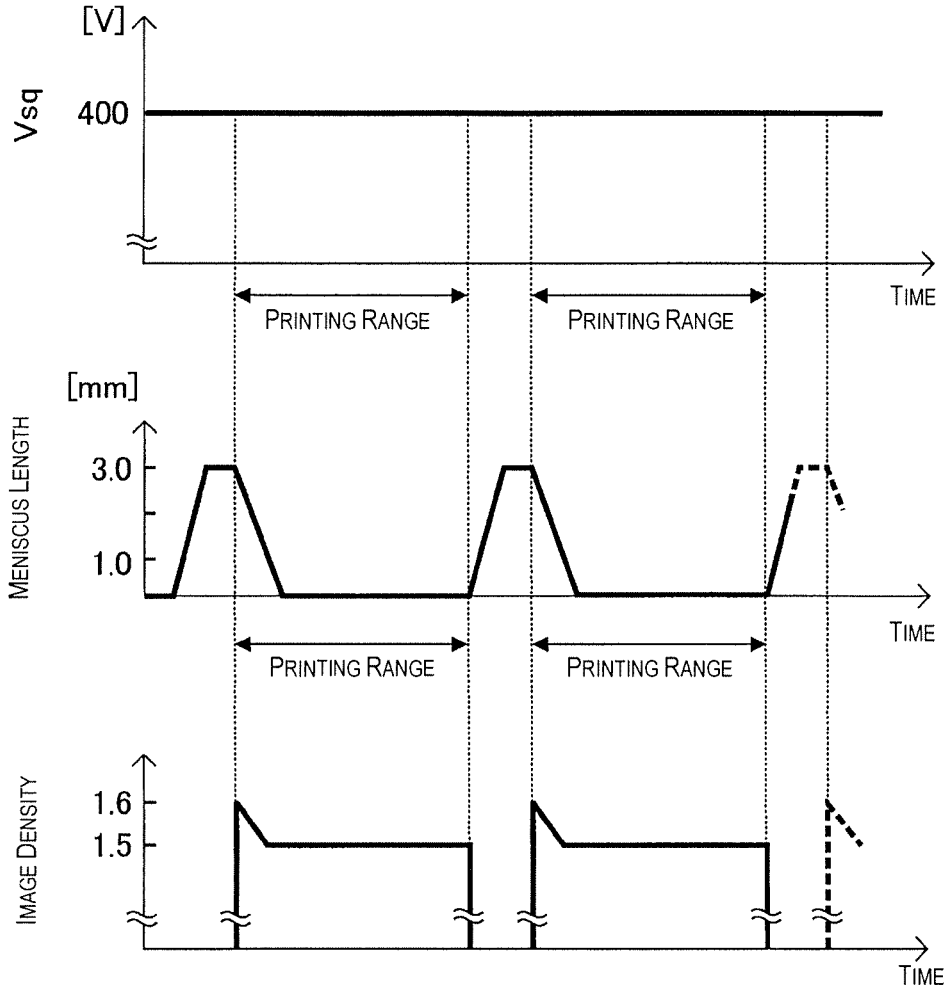
FIG. 7 is a view showing the changes in meniscus length and image density in the prior art.
Figure 14:
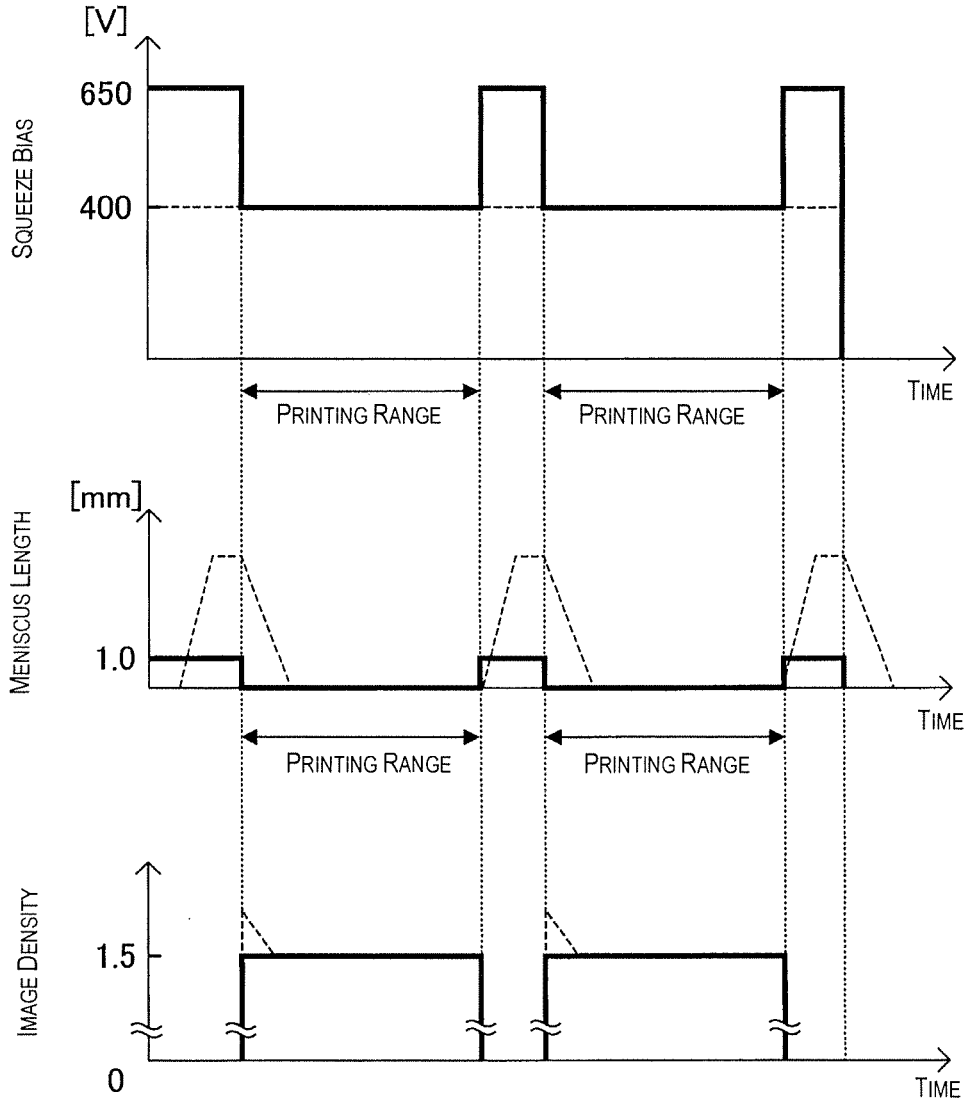
FIG. 14 is a view showing control of the squeeze bias in an embodiment of the invention.

FIG. 14 is a timing chart showing control of the bias applied to the first squeeze roller 13Y when continuous printing is performed and when solid images are formed in the printing ranges. In the present embodiment, change control is performed on the bias in all portions except for within the printing range. However, change control can be performed on the bias in at least some of the portions outside of the printing range as explained using the previous drawing. In order to compare the timing to the prior art, the timing charge in FIG. 7 is included using dotted lines.

The bias applied to the first squeeze roller 13Y is set to 400 V in the printing range, and 650 V outside of the printing range. In the range outside of the printing range, the absolute value is greater than the bias applied to the photoreceptor 10Y (600 V). The central control unit 100 determines where the first squeeze roller 13Y is positioned relative to the photoreceptor 10Y, and the bias control unit 101 is controlled accordingly. This control operation keeps the length of the meniscus formed in the range between printing ranges, that is, in the non-printing ranges, to approximately 1 mm, and a solid image is obtained in which the image density is at a constant value without any density abnormalities at the front end.

Figure 15:
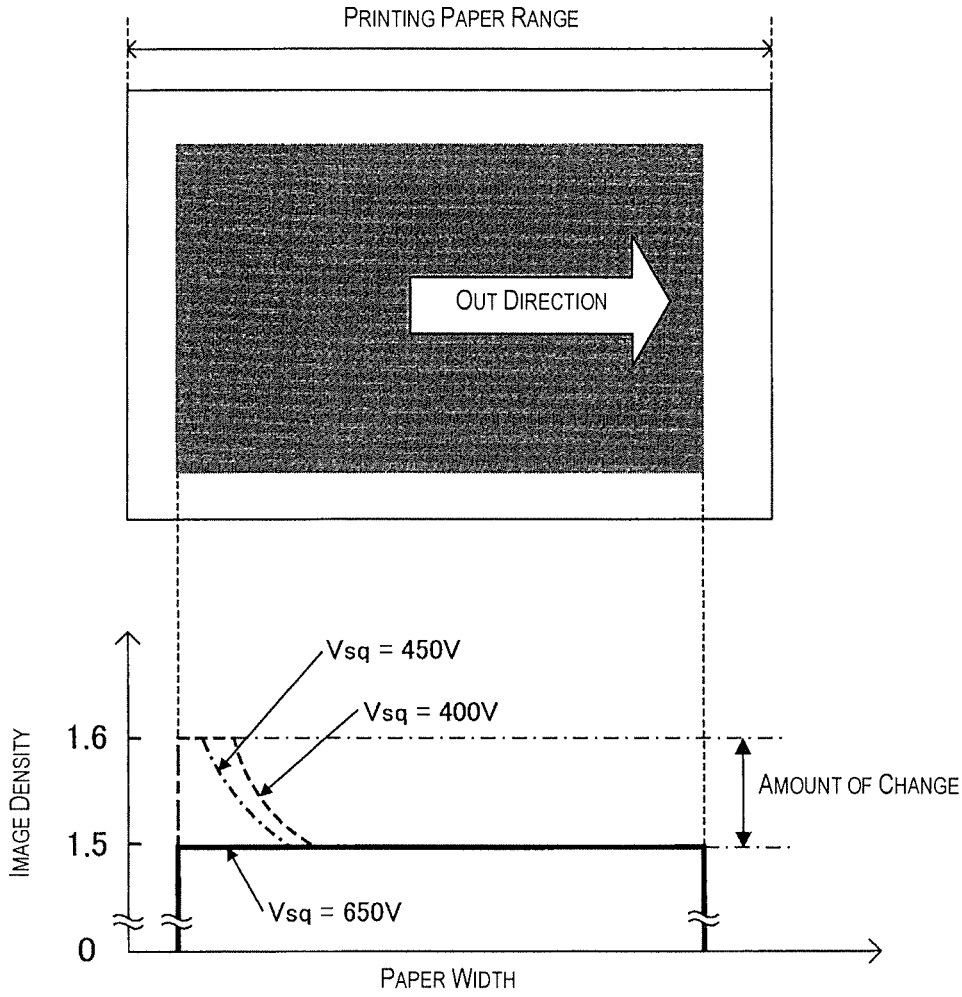
FIG. 15 is a view showing the image density distribution on printing paper in an embodiment of the invention.

FIG. 15 shows the image density distribution under the printing conditions for a solid image on printing paper. The dotted line indicates the situation (the state in the prior art) when the bias applied to the first squeeze roller 13Y is not controlled (Vsq=400 V), the dashed line indicates the situation when the bias applied to the first squeeze roller 13Y is set to 450 V, and the solid line indicates the situation when the bias is set to 650 V, i.e., the bias is greater than the bias of the photoreceptor 10Y in the non-image portion.

When the bias applied to the first squeeze roller 13Y in the non-printing range is greater than the bias of the photoreceptor 10Y in the non-image portion, the electric field acting between the first squeeze roller 13Y and the photoreceptor 10Y is reversed, and density abnormalities at the front end of the image can be effectively suppressed. When Vsq=450 V, density abnormalities can be suppressed without reversing the electric field simply by weakening the electric field.

As explained above, the invention is able to suppress the development of the meniscus formed between the squeeze roller and the photoreceptor (latent image carrier), eliminate density irregularities (density abnormalities at the front end of the image), and form high-quality images.

Various embodiments have been described in the present specification, but the invention is understood to include embodiments in which the configurations in these various embodiments are combined in appropriate ways.

GENERAL INTERPRETATION OF TERMS

In understanding the scope of the invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the invention, it will be apparent to those skilled in the art from this disclosure that various changes and modifications can be made herein without departing from the scope of the invention as defined in the appended claims. Furthermore, the foregoing descriptions of the embodiments according to the invention are provided for illustration only, and not for the purpose of limiting the invention as defined by the appended claims and their equivalents.

What is claimed is:

1. An image forming apparatus, comprising:

a latent image carrier that holds a latent image thereon;

a developer carrier that develops the latent image on the latent image carrier by using a liquid developer including a toner and a carrier liquid;

a squeeze roller being in contact with the latent image carrier, that holds an image developed by the developer carrier, to squeeze the liquid developer on the latent image; and a control unit that applies a first bias to the squeeze roller, when a first position of the latent image carrier that does not hold the latent image is in contact with the squeeze roller, and that applies a second bias being different from the first bias to the squeeze roller, when a second position of the latent image carrier that holds the latent image is in contact with the squeeze roller.

2. The image forming apparatus of claim 1, wherein an absolute value of the first bias is greater than an absolute value of the second bias.

3. The image forming apparatus of claim 1, wherein the latent image is a first latent image area on a first recording medium and a second latent image area on a second recording medium, and the first position is between the first latent image area and the second latent image area.

4. The image forming apparatus in claim 1, further comprising a second squeeze roller that contacts with the latent image carrier to rotate and squeeze the liquid developer on the latent image squeezed by the squeeze roller.

5. The image forming apparatus of claim 4, wherein the control unit applies a third bias to the second squeeze roller, and an absolute value of the third bias is smaller than the absolute value of the first bias and the second bias.

6. An image forming method, comprising:

contacting a developer carrier, on which a liquid developer having a toner and a carrier liquid is held, with a latent image carrier that does not hold a latent image;

contacting a squeeze roller applied a first bias with the latent image carrier that does not hold a latent image;

exposing the latent image carrier to light to form the latent image thereon;

developing the latent image on the latent image carrier by using the liquid developer; and contacting the latent image carrier that holds the developed latent image with the squeeze roller applied a second bias being different from the first bias.

7. The image forming method of claim 6, wherein an absolute value of the first bias is greater than an absolute value of the second bias.

* * * * *